US005168686A

United States Patent [19]

Guttinger

[11] Patent Number: 5,168,686

[45] Date of Patent: Dec. 8, 1992

[54] FORMATION, MAINTENANCE AND TENSIONING OF A TYING LOOP

[75] Inventor: Hans Guttinger, Gachnang, Switzerland

[73] Assignee: ATS Automatic Taping Systems AG, Zug, Switzerland

[21] Appl. No.: 695,252

[22] Filed: May 3, 1991

[30] Foreign Application Priority Data

May 10, 1990 [CH] Switzerland ..... 1594/90-1

[51] Int. Cl.[5] ..... B65B 13/06

[52] U.S. Cl. ..... 53/399; 53/389.2; 53/589; 100/25

[58] Field of Search ..... 53/389.2, 389.5, 589, 53/399; 100/25, 26, 33 PB

[56] References Cited

U.S. PATENT DOCUMENTS 2,913,270 11/1959 Sachsenroder ..... 100/26
3,020,827 2/1962 Luthi ..... 100/26
3,380,223 4/1968 Jasper ..... 53/389.5
3,385,026 5/1968 Schmermund ..... 53/389.5
3,831,512 8/1974 Johnson ..... 100/26
4,388,794 6/1983 Focke ..... 53/389.5

*Primary Examiner*—John Sipos
*Attorney, Agent, or Firm*—Bachman & LaPointe

[57] ABSTRACT

A tying machine for packaging articles in stack form comprises a band guide (12) limiting the extension of the loop and having a sliding surface (16). During the advance and after the end position has been reached, a winding band (18) is maintained by pneumatic means in a loop form determined essentially by the sliding surface (16), during the band pull-back is drawn out of the band guide (12) without the movement of any mechanical parts and is laid round the packaging articles.

The band guide (12) with the sliding surface (16) and lateral guides (36, 38) for maintaining the winding band (18) in a loop form has exclusively pneumatic means.

12 Claims, 3 Drawing Sheets

FORMATION, MAINTENANCE AND TENSIONING OF A TYING LOOP

Figure 1:
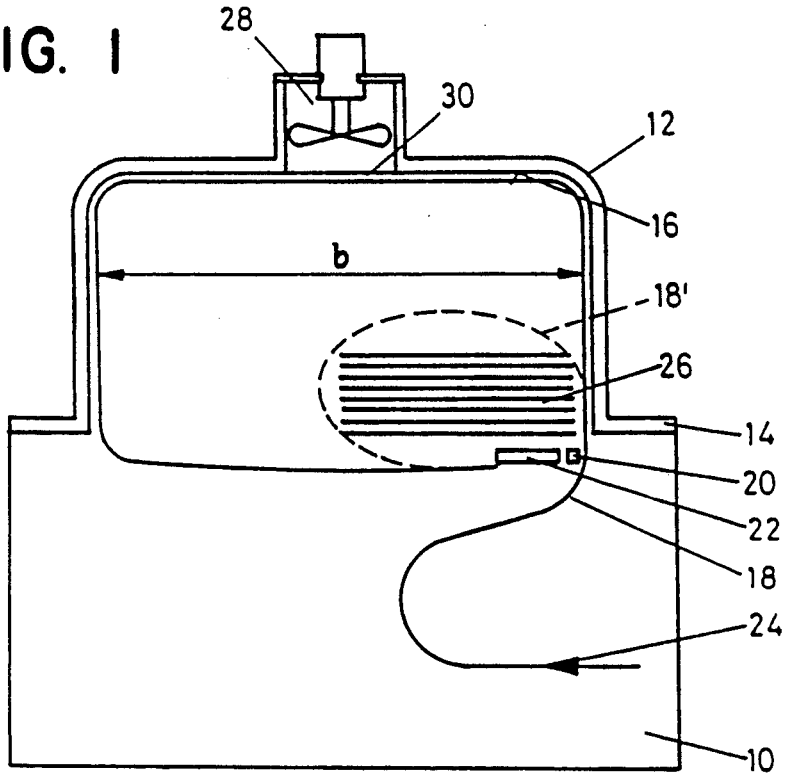

The present patent application relates to a process and an appliance for the formation, maintenance and tensioning of a loop round the packaging articles of a tying machine which comprises a band guide limiting the extension of the loop and having a sliding surface.

A tying machine processes square, rectangular, round or trapezoidal stacks by joining these together simultaneously or in succession by means of at least one band. The packaging articles can be hard or also very soft. Thus, for example, printed matter, trimmings, envelopes, labels, bank notes, cheques, visiting cards, books, pamphlets, newspapers, magazines, signs, but also pharmaceutical products, textile products, stockings, vegetable products, cheese boxes, meat packs, shoe soles or the like, can be tied in stacks.

A tying machine works semi-automatically or fully automatically. A winding band made of paper, plastic-coated paper or plastic forms a loop, into which the stack to be tied, namely the packaging articles, is introduced. Under the control of a sensor or triggered by the action of a hand or foot switch, the winding band, clamped tight at its free end, is pulled back until it rests flush against the packaging articles. Soft stacks can be pressed together to a greater or lesser extent by hand. The clamped end is then adhesively bonded or welded to the band pulled tight and is cut off.

EP-A2-0,057,471 describes a process and an appliance for the formation and tensioning of a tying loop round packaging articles. The loop is formed by pushing the band along a circular guide surface as far as a stop and then rotating the small loop out of the plane of the guide, thereby producing a free-standing arc. The packaging articles are introduced into the large widened arc and tied. Neither the tying process nor the appliance can be used for tying machines which work with substantially thinner and more pliable tying materials.

On tying machines of the known type, in order to form and maintain a winding-band loop of relatively large widths it is necessary to resort to mechanical suspension or support means. Only in this way does a large processing width become possible, without the loop sagging even before its complete expansion or before the introduction of the stack. However, devices which involve a relatively high outlay and which have to be synchronised with the work cycle need to be employed.

The disadvantage of mechanical means involving a high outlay for the formation and maintenance of a winding band is prevented by a known automatic loop formation, in that the band is guided from one lateral horn to the other and is thus maintained in an unsupported manner. Although this solution constitutes an important advance, it still has disadvantages:

it is necessary to use a relatively stable winding band which has the rigidity necessary for free maintenance.

Relatively narrow limits are placed on the width of the stack of packaging articles to be tied by a tying machine, and above 240 to at most 320 mm a band of conventional thickness and rigidity can no longer be maintained in an unsupported manner, even when it is of good quality.

The inventor's set object was, therefore, to provide a process and an appliance of the type mentioned in the introduction, which allow an automatic loop formation of any required width even with thin cheap winding bands, without mechanical means having to be employed for maintaining them. The loop formation will be carried out economically with a simple appliance.

With regard to the process, according to the invention the object is achieved in that, during the advance and after the end position has been reached, the winding band is maintained by pneumatic means in a loop form determined essentially by the sliding surface and, during the band pull-back, is drawn out of the band guide without the movement of any mechanical parts. Dependent patent claims relate to special embodiments and developments of the invention.

With the exception of the pneumatic maintenance of the forming and formed loop, the tying proceeds in the customary way at a work cycle of approximately 20 to 30 tyings per minute.

Multiple tyings can be executed by introducing the stack of packaging articles into a band guide twice or by the simultaneous arrangement of two or more band guides of a tying machine.

According to a first version of the process of the invention, a vacuum is generated by the pneumatic means in the region of at least part of the sliding surface. Even a vacuum with only a few millibars below the normal pressure can suffice for forming and maintaining a winding-band loop of thin material. A small loop is first formed by means known per se and is widened as a result of the rapid pushing of the winding band. Even when only in the vicinity of the sliding surface, the loop is sucked up and, after reaching the end position, is maintained until the pull-back takes place. Too high a vacuum would disturb or even prevent the sliding of the winding band also occurring during the widening of the loop and/or, where particular materials are concerned, would lead to static charges.

According to a second version of the process, an airstream flowing obliquely upwards from the outer lower edges of an essentially U-shaped downwardly open band guide is directed to at least part of the sliding surface and conveyed away from there. Similarly to a low vacuum, a slight overpressure is sufficient here to support a winding band pushed along the sliding surface of the band guide. The injection effect generated is sufficient to suck up the loop widened into the vicinity of the sliding surface.

The pneumatic means for generating a vacuum or an overpressure are preferably switched on and off with the tying machine. Since only low vacuums or overpressures are generated, the energy expended during the idle time is insignificant, especially because the machine is stopped in any case during lengthy interruptions. Of course, the tying machine can be equipped with a switch which can be actuated manually or by foot pressure and which makes it possible to switch the pneumatic means on and off separately. Finally, the actuation of the pneumatic means can also be sensor-controlled, particularly when the tying machine is used only periodically for tying individual stacks. This sensor position can be set, for example, by means of the manual on/off switch.

As regards the appliance for carrying out the process, according to the invention the object is achieved in that the band guide together with the sliding surface and lateral guides for maintaining the winding band in a loop form has exclusively pneumatic means. Dependent patent claims relate to special embodiments and developments of the invention.

No mechanical supports or bearing surfaces of any kind are used for maintaining the winding band.

The length of the band guide determines the width of the packaging articles which can be tied by the tying machine. This can be extended to approximately 50 cm or more, without any machine-related adjustment of the band quality and thickness The band guide is designed so that it can be mounted with appropriate dimensions on all tying machines found in the trade, expediently by only a few minor manipulations. Assembly kits allowing a push-on connection on the horns of a tying machine have proved especially advantageous The band guide can also be longitudinally adjustable on design principles known per se, for example in that it can be extended telescopically.

Some pneumatic means serve for generating a vacuum and others for generating an overpressure. However, both the vacuum and the overpressure are only low, and preferably they differ only a little from the normal pressure, for example in the range of 5 to 100 Mb (millibars).

To generate a vacuum between the band guide with the sliding surface and lateral guides on the one hand and the winding band on the other hand, the former has at least one orifice, above which a suction fan or a suction pipe or a suction hose of a suction fan is arranged. Because it only has to have a low efficiency, the fan or the fans are made relatively small and low-power, this being advantageous in all respects. The suction generated merely has to maintain the winding band.

For loop formation by widening, the winding band must also be capable of sliding along the sliding surface, even if only a little, without the latter opposing any appreciable resistance. The winding band should therefore adhere only slightly.

Preferably, a fan with a corresponding orifice can be displaced in a longitudinal direction of the band guide into different positions, depending on the band quality. This applies in a similar way to a suction hose with a corresponding orifice. A widening loop can thereby be grasped in the best possible way. If a plurality of orifices assigned to a suction fan or suction hose is arranged in a sliding surface, these can, of course, also be displaced in the longitudinal direction of the band guide.

To prevent the winding band from bulging out in a large-size orifice or orifices of the sliding surface assigned to a suction fan or suction hose, supporting webs extending approximately in the longitudinal direction of the band guide are provided.

If at least one abovementioned orifice is provided, the sliding surface is preferably made smooth and consists at least superficially of a material which causes no or only a slight static charge during a displacement of the winding band.

Instead of at least one large-area orifice, the sliding surface can be at least partially perforated, pierced with holes or slotted and have a chamber under an appropriate vacuum between the sliding surface and the band guide.

Finally, the sliding surface can consist at least partially of a woven fabric, knitted fabric, nonwoven or fine-mesh netting, but it is necessary to ensure that the winding band can also slide.

In all the versions of the design of the sliding surface with one orifice, a plurality of orifices or perforations, there can be ribs which extend in a longitudinal direction and which themselves constitute, at a distance from the rear wall of the band guide, a new sliding surface formed by the ribs. This version is advantageous especially for band materials which tend in combination with the sliding surface to static charging. Furthermore, when only a single suction orifice is formed, the suction effect can be better distributed and exerted earlier. In this case, however, the airstream is not stopped by the band resting on them.

The suction means can be designed so that a vacuum is generated in only some of the interspaces located in between the ribs when the winding band rests on them. For example, the vacuum can be generated only in the middle interspace or interspaces and/or the outer interspaces.

As mentioned, instead of a vacuum, a slight overpressure can be generated by arranging in a downwardly open U-shaped band guide with a sliding surface, at the lower edge of the parallel legs, air-outflow nozzles, holes and/or slots with an airjet flowing out in the direction of the sliding surface. The outflowing air maintains the loop-forming winding band. It is pressed lightly against the sliding surface or can be held at least partially in suspension.

Some of the nozzles, holes or slots can be directed forwards in the direction of advance of the winding band and bring about a band advance, and this can be advantageous especially where thin soft band material is concerned.

In a further version, all the air-outflow nozzles, holes and/or slots are directed slightly forwards and achieve the same effect.

Although the processes and the appliance according to the invention can be employed for all known tying machines, with all known winding bands being used, the advantages have an especially beneficial effect where thin, soft bands are concerned. Particularly in interaction with advancing nozzles, winding bands can be made thinner and softer than has been conventional hitherto and can nevertheless be used for wide loops.

Figure 2:
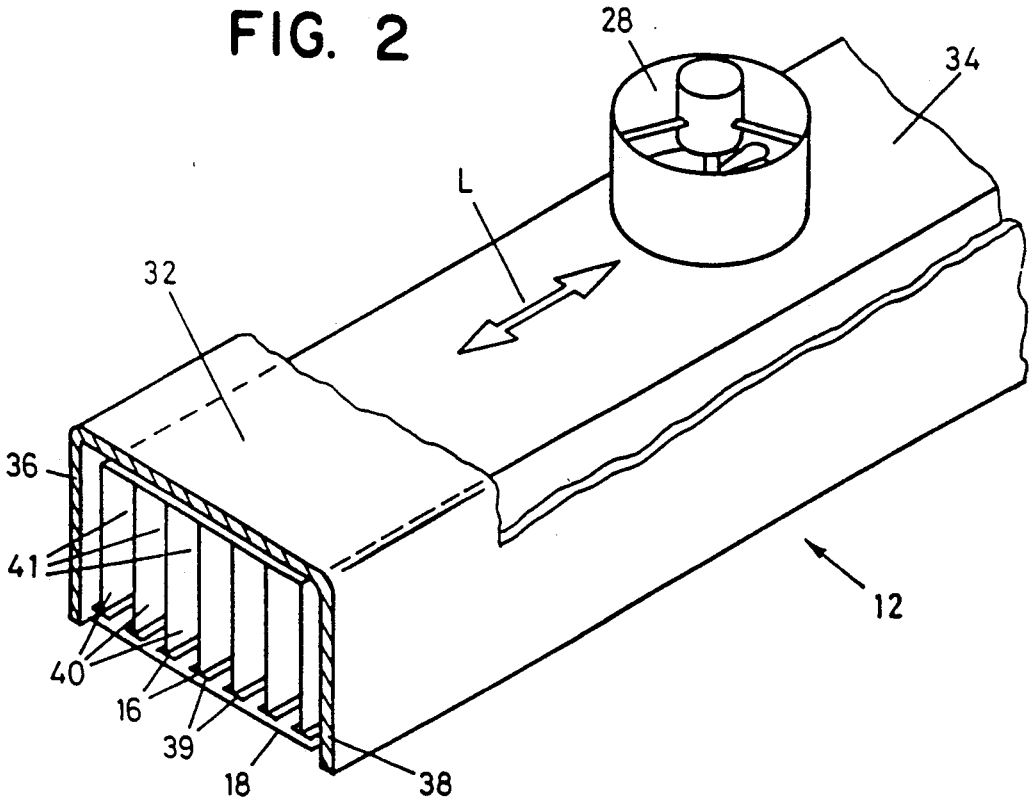
Figure 3:
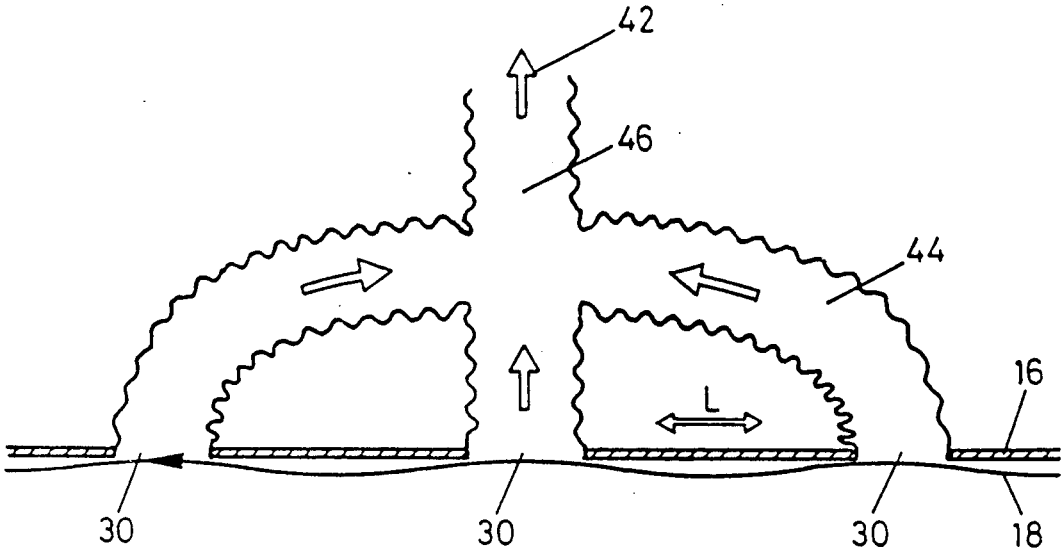
Figure 6:
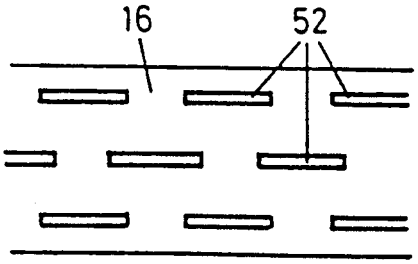
Figure 7:
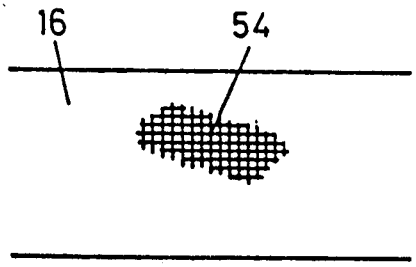
Figure 8:
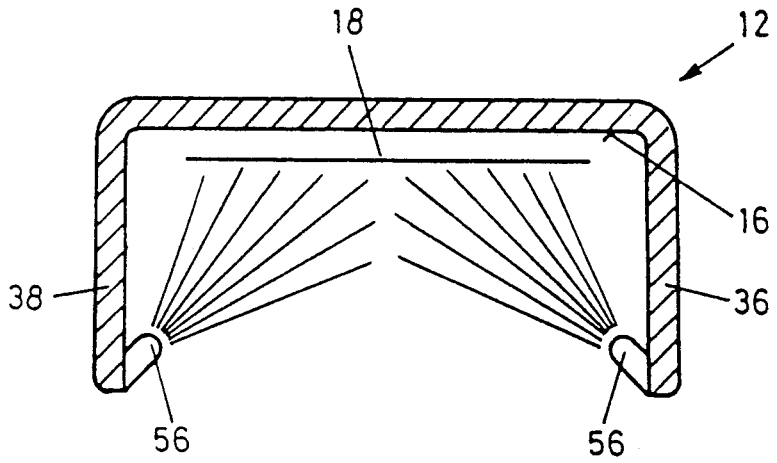
Figure 9:
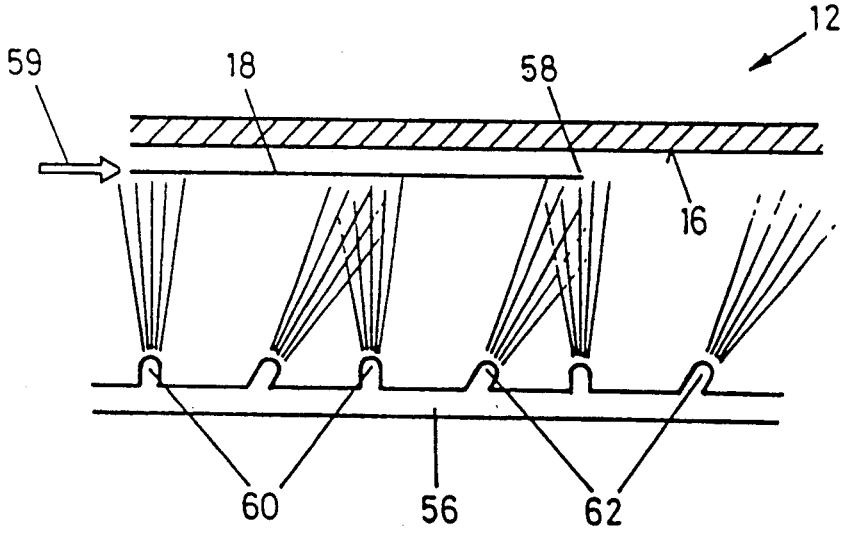

The invention is explained in more detail by means of exemplary embodiments which are illustrated in the drawing and which are also the subject of dependent patent claims. In the diagrammatic drawing:

FIG. 1 shows a cutaway basic diagram of a tying machine with a flanged-on band guide, FIG. 2 shows a perspective view of a band guide displaceable in its longitudinal direction, FIG. 3 shows a cutaway view of suction hoses connected to a band guide, FIGS. 4–7 show different embodiments of sliding surfaces with air suction, FIG. 8 shows a cross-section through a band guide with airstreams, and FIG. 9 shows a partial longitudinal section through a band guide with a nozzle strip.

A band guide 12 with an inner sliding surface 16 is arranged by means of flanges 14 on the tying machine 10, also called a banding machine, illustrated in FIG. 1. A small loop of the winding band 18 is first formed by known means and is pushed open to form a large loop by means of an advance mechanism likewise known per se and therefore not shown. The broken line 18' shows the widening loop in an intermediate stage, and of course at this time the packaging articles have not yet been introduced. The winding band 18 represented by an unbroken line shows the final stage of the loop formation.

Of the devices known per se arranged on the tying machine, such as draw-in rollers, oppositely rotating tension rollers, band-width adjustment, band clamps, holding-down devices and knives, for the sake of simplicity and clarity only the welding plate 22 for connecting the advanced end face of the winding band to the pulled-back winding band 18 itself is shown. The advance is determined by the clamping time of the winding band between the draw-in rollers rotating at constant speed. The pull-back is triggered after a sensor 20 indicates the insertion of packaging articles 26, and takes place as a result of the clamping of the winding band 18 between the tension rollers in the opposite direction to the arrow 24. After the pull-back under an adjustable pulling force, the winding band 18 surrounds with a flush fit the inserted stack, namely the packaging articles 26. Of course, instead of the sensor control, a manual control can also be carried out.

On a conventional tying machine with a large working width, a winding band of relatively large thickness and high rigidity would have to be chosen so that the width could be bridged. This would be not only expensive, but also impractical for the laying of the winding band flush against the packaging articles.

According to FIG. 1, approximately in the middle of the band guide 12 there is a suction fan 28 with an orifice 30 located in the sliding surface 16 and corresponding to the inner cross-section. The winding band 18 pushed in the direction of the smooth sliding surface 16 during the widening of the loop is sucked up in the region of the orifice 30 and therefore cannot sag downwards when the tensioning force over the width b is insufficient. However, the suction effect is not so high as to be detrimental to displacement.

If the width b is even larger, a plurality of suction fans 28 can be arranged in succession.

The sliding surface 16 has lateral guides (not shown) in the form of a U downwardly open in cross-section (FIG. 2), to prevent the winding band 18 from escaping.

FIG. 2 shows two sections located one inside the other and displaceable relative to one another in the longitudinal direction L of the band guide 12. The outer section 32 is pushed in a way not shown onto two lateral horns of the tying machine. The outer section 32 is essentially U-shaped in cross-section with a downwardly directed orifice, and it corresponds essentially to a sliding surface with lateral guides according to FIG. 1.

An inner section 34 displaceable in a longitudinal direction L in the outer section 32 possesses ribs 40 extending parallel to the legs 36, 38 of the outer section 32. On their end face these ribs 40 have bearing surfaces 39 which extend at right angles and which form the sliding surface 16. The legs 36, 38 designed as lateral guides project considerably beyond the ribs 40.

FIG. 3 illustrates the sliding surface 16 of a very wide band guide 12 (FIG. 1). The low vacuum exerting suction on the winding band 18 is generated in the direction of the arrow 42 in a fan (not shown). Suction hoses 44 adjoin altogether three orifices 30 in the sliding surface 16 and unite in the direction of the fan to form a common suction hose 46.

The suction hoses 44, 46 are so designed that the sliding surface 16 can be displaced in its longitudinal direction (L).

Figure 4:
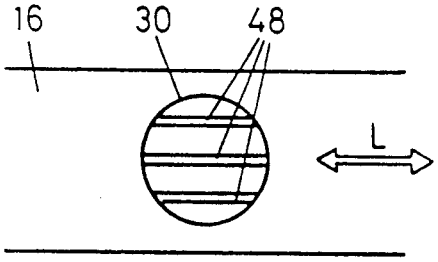

FIG. 4 shows an orifice 30 according to FIGS. 1 and 3 from below. Supporting webs 48 are arranged in the longitudinal direction L of the band guide. These prevent a thin and relatively flexible winding band 18 (FIGS. 1 and 3) from being sucked into the relatively large orifice 30 despite the low vacuum.

Figure 5:
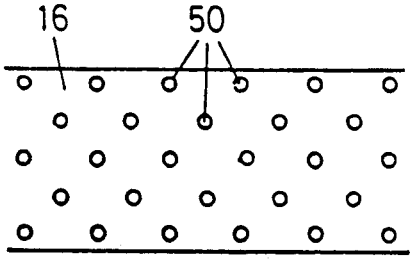

In the embodiment according to FIG. 5, at least part of the sliding surface 16 is designed as a perforated plate with numerous small bores 50 of a diameter of a few millimeters, and in FIG. 6 as a slotted plate with longitudinal slots 52 of a length of a few centimeters and a width of a few millimeters.

In FIG. 7, at least part of the sliding surface 16 is designed as a woven fabric 54.

The band guide 12 shown in cross-section in FIG. 8 is made essentially U-shaped with a downwardly directed orifice. The parallel legs 36, 38 each carry at the lower end a nozzle strip 56 with air-outflow holes directed obliquely upwards. The airstream can hold the winding band 18 in suspension or presses it lightly against the sliding surface 16 of the band guide 12.

Air-outflow orifices (not shown) are made in the sliding surface 16. Underneath the band guide occurs an injector effect which sucks a light winding band 18 into the effective range of the nozzle strips 56 when the loop is being pushed open.

During the band pull-back, as in the versions employing a vacuum, the winding band 18 can easily be drawn out of the band guide 12 and tensioned around the packaging articles, without any mechanical parts having to be moved in synchronism.

FIG. 9 shows a partial longitudinal section through a band guide 12 with the leading edge 58 of the winding band 18 which is advanced in the direction of the arrow 59.

The nozzle strip 56 has individual nozzles instead of bores, some nozzles 60 extending perpendicularly relative to the sliding surface 16 and the others being designed as advancing nozzles 62. Imparting and advance can be advantageous, above all, where thin flexible bands 18 are concerned.

I claim:

1. Process for the formation, maintenance and tensioning of a loop round the packaging articles (26) of a tying machine (10) which comprises a band guide (12) limiting the extension of the loop and having a sliding surface (16), characterised in that, advancing a winding band in said band guide along said sliding surface, stopping said band upon reaching an end position, pulling back on said band to draw it out of said band guide and maintaining said band exclusively by pneumatic means impinging on said band against said sliding surface during the advance and after the end position has been reached, in a loop form determined essentially by the band guide and during band pull-back.

2. Process according to claim 1, characterised in that a vacuum is generated in the region of at least part of the sliding surface (16).

3. Process according to claim 1, characterised in that an airstream flowing obliquely upwards from outer lower edges of legs (36, 38) of an essentially U-shaped downwardly open band guide (12) is directed in the region of at least part of the sliding surface (16).

4. Process according to claim 1, characterised in that the pneumatic means advance the winding band.

5. A tying machine for binding packaging articles (26) with a winding band (18) having a band guide (12) for limiting the extension of a loop formed from said winding band and said band guide having a sliding surface (16) and lateral guides (36, 38), means for advancing and retracting said band in said guide along said sliding surface, pneumatic means mounted on said guide for controlling the loop in the band guide (12), characterised in that the band guide (12), together with the sliding surface (16) and lateral guides (36, 38) has exclusively said pneumatic means impinging on said band for maintaining the winding band (18) against the sliding surface in loop form during the advancement, retraction and stationary position of said band.

6. A tying machine according to claim 5, characterised in that the band guide (12) is preferably longitudinally adjustable and is connected releasably to the tying machine (10) or can be pushed onto its horns.

7. A tying machine according to claim 5, characterised in that the sliding surface (16) of the band guide (12) has at least one orifice (30, 50, 52), and said pneumatic means comprises at least one of a suction fan (28) and a suction hose (44) of a suction fan (28) arranged above said at least one orifice for generating a vacuum and therefore suction between the sliding surface (16) and the winding band (18).

8. A tying machine according to claim 7, characterised in that said pneumatic means together with said at least one orifice (30) are adjustable in a longitudinal direction (L) of the band guide (12), and the at least one orifice has supporting webs (48) preferably extending in the longitudinal direction (L).

9. A tying machine according to claim 7, characterised in that the sliding surface (16) is at least one of being at least partially perforated, pierced with holes and slotted or consists at least partially of at least one of a woven fabric, a knitted fabric, a nonwoven netting and a fine-mesh netting.

10. A tying machine according to claim 8, characterised in that the sliding surface (16) consists of bearing surfaces (39) of longitudinal ribs (40), with at least some interspaces (41) between the ribs (40) having a vacuum when the winding band (18) is resting on them.

11. A tying machine according to claim 5, characterised in that the band guide (12) is made essentially U-shaped and downwardly open having two parallel legs, and the pneumatic means comprises lower edges of the parallel legs (36, 38) having at least one of air-outflow holes, slots and nozzles (60, 62) with an air jet flowing out in the direction of the sliding surface (16).

12. A tying machine according to claim 11, characterised in that at last some of the at least one of air-outflow holes, slots and nozzles are designed as advancing nozzles (62) for the winding band (18).

* * * * *